United States Patent [19]

Rimpi

[11] Patent Number: 4,561,934

[45] Date of Patent: Dec. 31, 1985

[54] METHOD OF RECOVERING CHEMICALS FROM CHLORIDE-CONTAINING GREEN LIQUOR

[75] Inventor: Pertti K. Rimpi, Tampere, Finland

[73] Assignee: Oy Tampella AB, Tampere, Finland

[21] Appl. No.: 536,640

[22] Filed: Sep. 28, 1983

[30] Foreign Application Priority Data

Oct. 20, 1982 [FI] Finland ..... 823587

[51] Int. Cl.[4] ..... D21C 11/04

[52] U.S. Cl. ..... 162/30.1; 162/30.11; 162/DIG. 8

[58] Field of Search ..... 162/30.1, 30.11, DIG. 8, 162/29, 31

[56] References Cited

U.S. PATENT DOCUMENTS

| | | | |
|---|---|---|---|
| 3,508,863 | 4/1970 | Kiminki et al. | 162/30.1 |
| 3,841,961 | 10/1974 | Saiha | 162/30.1 |
| 3,841,962 | 10/1974 | Proctor et al. | 162/30.1 |
| 4,093,508 | 6/1978 | Henricson | 162/30.11 |
| 4,138,312 | 2/1979 | Gill et al. | 162/30.1 |
| 4,187,279 | 2/1980 | Rimpi | 162/30.1 |
| 4,253,911 | 3/1981 | Hillstrom et al. | 162/30.1 |
| 4,288,286 | 9/1981 | Fuller | 162/30.1 |

FOREIGN PATENT DOCUMENTS

| | | | |
|---|---|---|---|
| 2449131 | 6/1975 | Fed. Rep. of Germany | 162/30.11 |
| 50-3801 | 2/1975 | Japan | 162/DIG. 8 |

OTHER PUBLICATIONS

Pulp & Paper Canada 85:2 1984, pp. 31–34.

*Primary Examiner*—William Smith

*Attorney, Agent, or Firm*—Roylance, Abrams, Berdo & Goodman

[57] ABSTRACT

The invention relates to a method of recovering chemicals from chloride-containing green liquor by precarbonating the green liquor by means of flue gases into hydrosulfide and soda, by removing hydrosulfide from the precarbonated solution in the form of hydrogen sulfide, by evaporation crystallizing the chloride- and soda-containing solution in order to separate the chloride salt from the alkaline solution. In order to reduce releases of hydrogen sulfide, the produced hydrogen sulfide is absorbed into a soda solution and/or an alkaline solution in order to produce a solution suitable for the preparation of white liquor, whereas the hydrogen sulfide which remains unabsorbed is returned to the precarbonation stage, in which the hydrogen sulfide is absorbed substantially completely. By means of the invention it is possible to achieve a closed cycle of chemicals without the chloride load of the system increasing, and at the same time the chloride is recovered and returned to the bleaching.

17 Claims, 3 Drawing Figures

Liquid flows
Gases
Solids

METHOD OF RECOVERING CHEMICALS FROM CHLORIDE-CONTAINING GREEN LIQUOR

BACKGROUND OF THE INVENTION

The present invention relates to a method of recovering chemicals from chloride-containing green liquor. This invention relates in particular to a method of recovering the digesting and bleaching chemicals used in paper making. The method according to the present invention is especially usable in pulp mills in which a closed cycle of the bleaching chemicals is used. In such closed systems, chloride tends to concentrate and corrode the apparatus, unless it is removed in some way.

The object of the present invention is thus to provide a method for recovering chemicals, and especially hydrogen sulfide, sodium carbonate and sodium chloride, from a chloride-containing green liquor which has been obtained by burning a mixture of black liquor and chloride-containing solutions obtained from the bleaching.

The removal of sodium chloride from closed sulfate cellulose processes is described in, for example, U.S. Pat. No. 3,698,995, No. 3,746,612 and No. 3,909,344. The efficiency of these methods is, however, limited; they require a large amount of steam for evaporation and are expensive in investment.

U.S. Pat. No. 4,138,312 describes a method for the recovery of sodium carbonate from the chloride-containing waste liquor from soda cooking, the sodium carbonate being crystallized in the form of a monohydrate and being carbonated thereafter.

The object of the present invention is thus to provide a method, more efficient than previously, for the recovery of chemicals from chloride-containing green liquor, and in particular from a green liquor which has been obtained by burning black liquor derived from sulfate digestion and a chloride-containing bleaching solution. In addition, the other sodium chemicals can be recovered in a substantially chloride-free form so that, after causticization, they can be used for preparing white liquor. By the method according to the invention it is possible to separate the chlorides in crystalline form, as sodium chloride, from which it is easy to prepare a new bleaching solution. In addition, by the method according to the invention the hydrogen sulfide formed from the sodium hydrosulfide present in the green liquor can be recovered with maximum efficiency and be converted to sulfide chemicals suitable for the production of white liquor.

SUMMARY OF THE INVENTION

In the method according to the present invention, a chloride-containing green liquor which has been formed by burning, for example the black liquor of sulfate digestion and bleaching solutions is contacted with flue gases in order to precarbonate the sulfide present in the green liquor to obtain hydrogen sulfide and soda. The hydrosulfide is removed from the precarbonated solution in the form of hydrogen sulfide, for example by the method known from FI Pat. No. 54 946, by causing the precarbonated solution to react with bicarbonate to form sodium carbonate and hydrogen sulfide, the latter being removed in gaseous form. The chloride- and soda-containing solution derived from the separation of hydrogen sulfide can thereafter be evaporation crystallized in order to separate the soda in crystalline form, whereafter the mother liquor can be causticized and evaporation crystallized in order to separate the sodium chloride salt from the alkaline solution.

In accordance with the present invention, the hydrogen sulfide derived from the separation of hydrogen sulfide is absorbed into the above-mentioned alkaline solution or into a soda solution prepared from the crystalline sodium carbonate obtained from the separation of hydrogen sulfide, in order to produce a solution suitable for the preparation of white liquor. The small amount of hydrogen sulfide which remains unabsorbed is returned according to the present invention to the precarbonation, in which the pH is much higher than in the absorption apparatus, so that the hydrogen sulfide is absorbed substantially completely and reacts with the sodium carbonate present in the green liquor, thereby forming sodium hydrosulfide and sodium bicarbonate. By this procedure, releases of hydrogen sulfide can be minimized and in the ideal case even totally eliminated.

Alternatively, both the soda solution and the alkaline solution can be directed to the hydrogen sulfide absorption stage.

DESCRIPTION OF THE PREFERRED EMBODIMENTS

According to a preferred embodiment of the present invention, the evaporation crystallization is carried out either entirely or at least partly before the precarbonated solution is directed to the hydrogen sulfide separation stage. In this manner, most of the sodium carbonate can be separated already at a point prior to the hydrogen sulfide separation apparatus, whereby the amounts of solution and gas passing through this apparatus are substantially decreased. Therefore the size of the hydrogen sulfide separation apparatus, and of the carbonation and flue gas scrubbing apparatus connected with it, can be substantially reduced, and thus savings in costs can be achieved. In this embodiment, all the solution from the precarbonation and possibly part of the solution from the hydrogen sulfide separation stage, are directed to the apparatus for the evaporation crystallization of soda, from which the obtained mother liquor is directed into the hydrogen sulfide separation apparatus. The heating of the solution to be evaporation crystallized is achieved effectively by bringing these solutions into indirect heat exchange contact with the hot gas flows produced in different sub-processes; when necessary, the temperature of these gas flows can be raised by compressing the gases. Thus, for example, gases produced in the evaporation crystallization can be compressed and used for heating the solution to be evaporation crystallized, whereafter the uncondensed gases are finally combined with the hydrogen sulfide flow into the hydrogen sulfide absorption.

The invention is described below in greater detail with the aid of examples and with reference to the accompanying drawings.

EXAMPLE 1

Figure 1:
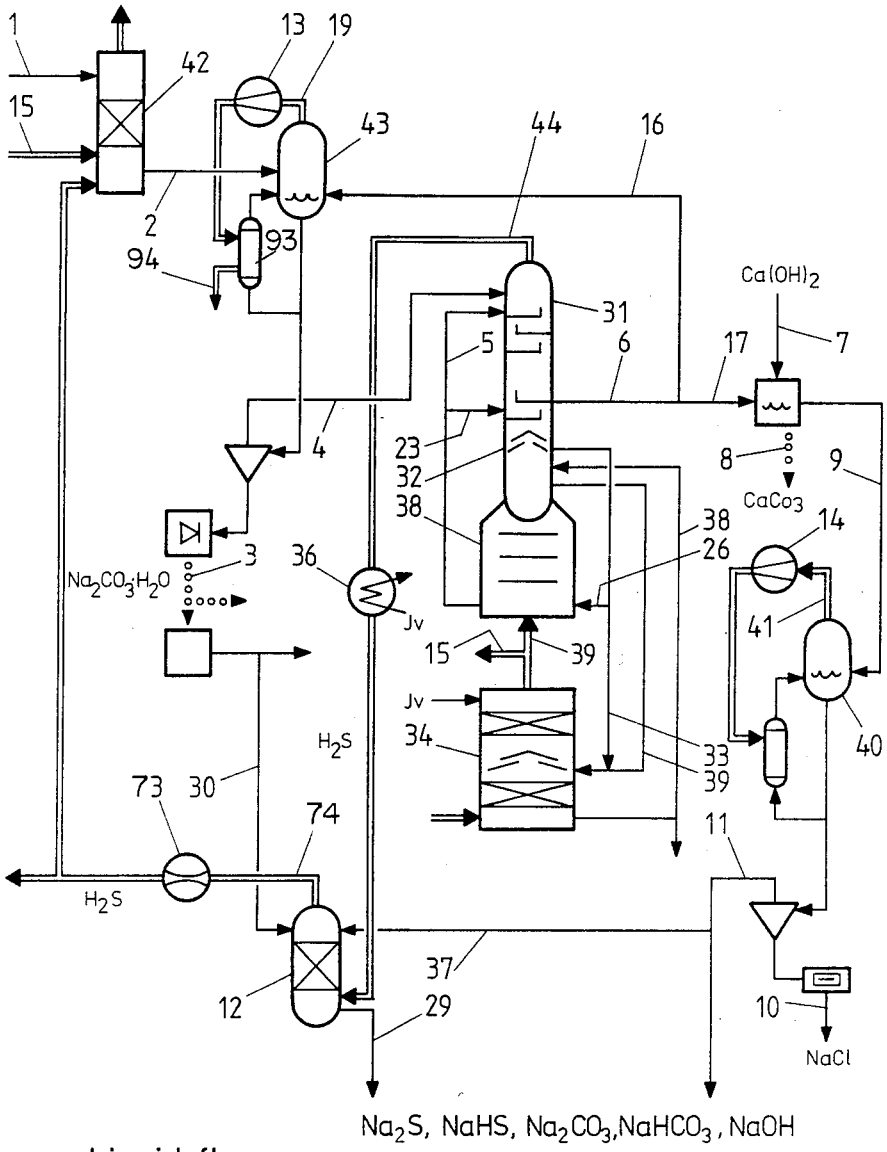
FIGS. 1, 2, and 3 illustrate three different process flow charts for carrying out the method according to the invention.

Into the process depicted in FIG. 1, green liquor 1 is fed at 40.4 $m^3/h$, containing $Na_2CO_3$ 62.7 kmol/h, $Na_2S$ 19.6 kmol/h, $Na_2SO_4$ 3.9 kmol/h and NaCl 10.4 kmol/h.

The precarbonation of the solution in the reactor 42 in accordance with the reaction $$2Na_2S+H_2O+CO_2-2NaHS+Na_2CO_3 \quad (1)$$

consumes carbon dioxide $0.5\times19.6$ kmol/h$-9.8$ kmol/h. Flue gases 15 are required for the precarbonation at 3290 $m^3n/h$, the inlet concentration of carbon dioxide being 12.97% and the degree of absorption of carbon dioxide being 51.7%.

The precarbonated solution 2 is directed from the reactor 42 to evaporation crystallization 43, to which part of the solution 16 obtained from the first hydrogen sulfide separation stage is also fed, in an amount of 1.2 $m^3/h$ and containing $Na_2CO_3$ 2.3 kmol/h, $NaHCO_3$ 0.9 kmol/h, NaHS 0.15 kmol/h, NaCl 1.6 kmol/h, and $Na_2SO_4$ 0.03 kmol/h.

In the evaporation crystallization 43, water is evaporated at 34.8 t/h, $Na_2CO_3.H_2O$ crystals being separated at 63.6 kmol/h and $Na_2SO_4$ crystals at 3.7 kmol/h in the crystallizer 3. The mother liquor 4, 6.8 $m^3/h$, containing $Na_2CO_3$ 6.3 kmol/h, NaHS 19.7 kmol/h, $Na_2SO_4$ 0.2 kmol/h, and NaCl 12 kmol/h, is directed to the first hydrogen sulfide separation stage 31. Gases generated in the evaporation crystallizer exit through line 19 and are compressed in compressor 13. The compressed hot gases enter condensor 93 and are subsequently used to raise the temperature of the solution to be evaporation crystallized. Uncondensed gases exit through line 94 and can be combined with the hydrogen sulfide gases 44 from the hydrogen sulfide separation stage.

In order to separate hydrogen sulfide in accordance with the reaction $$NaHS+NaHCO_3 \rightleftharpoons Na_2CO_3+H_2S$$

bicarbonate is required, which is introduced 5 into the first stripping stage 31 at 26.6 kmol/h and, along with it, carbonate is introduced at 7.4 kmol/h.

During the first hydrogen sulfide separation stage 31, hydrogen sulfide is separated at 17.4 kmol/h from the sulfide of the inlet solution 4. In the separation of hydrogen sulfide, bicarbonate is consumed not only in the principal hydrogen sulfide reaction but also in the secondary reaction $$2NaHCO_3 \rightleftharpoons Na_2CO_3+CO_2+H_2O$$

corresponding to a bicarbonate amount of 1.8 kmol/h in the first stripping stage.

From the first hydrogen sulfide separation stage 31, solution passes to the second hydrogen sulfide separation stage 32 at 9 $m^3/h$, the solution containing $Na_2CO_3$ 17.6 kmol/h, $NaHCO_3$ 3.8 kmol/h, NaHS 1.1 kmol/h, $Na_2SO_4$ 0.2 kmol/h, and NaCl 12 kmol/h.

The rest of the sulfide-containing solution 6 coming from the first hydrogen sulfide separation stage amounts to 9 $m^3/h$ and contains $Na_2CO_3$ 17.1 kmol/h, $NaHCO_3$ 3.6 kmol/h, NaHS 1.1 kmol/h, $Na_2SO_4$ 0.2 kmol/h, and NaCl 12 kmol/h, and it passes in part as flow 17, 7.8 $m^3/h$, to causticization and in part as flow 16, 1.2 $m^3/h$, to soda crystallization 43.

To the second hydrogen sulfide separation stage 32, bicarbonate is directed 23 at 3.4 kmol/h and carbonate at 0.9 kmol/h. In the second hydrogen sulfide separation stage, bicarbonate is consumed at 3.2 kmol/h.

The hydrogen sulfide being separated in the second hydrogen sulfide separation stage 32 passes to the first stripping stage 31, from which it is removed together with the $H_2S$ gas being separated in the first stripping stage, a combined total of $H_2S$ 18.4 kmol/h, from which the water vapor is condensed in a condenser 36, and this gas can be used for various purposes, e.g. burned to form $SO_2$, directed to a Claus plant, or be absorbed into a solution which contains sodium carbonate, sodium hydroxide and/or sodium sulfide. In this example, $H_2S$ gas 18 is absorbed 12 into a NaOH solution 37 produced in the process, the solution containing NaOH 30 kmol/h, $Na_2CO_3$ 2 kmol/h, $Na_2S$ 1 kmol/h, $Na_2SO_4$ 0.2 kmol/h, and NaCl 1.4 kmol/h. The outlet gases 74 from the $H_2S$ absorption 12 are directed to the precarbonization 42 by means of a vacuum pump 73, by means of which the operating pressure of the hydrogen sulfide separation stages 31, 32 and of the $H_2S$ absorption 12 is adjusted.

The bicarbonate 5, 23 required for the separation of hydrogen sulfide is prepared, using the carbon dioxide present in the flue gases, during the carbonation stage 38 in accordance with the reaction $$Na_2CO_3+CO_2+H_2O \rightleftharpoons 2NaHCO_3$$

From the solution leaving the second hydrogen sulfide separation stage 32, a flow 26 is directed to carbonation ($Na_2CO_3$ 21.5 kmol/h and $NaHCO_3$ 3.8 kmol/h), during which it is treated with flue gases 39, 58310 $m^3n/h$, having a $CO_2$ content of 12.97%. During the carbonation 38 at an absorption efficiency of 3.8%, carbon dioxide is absorbed at 13.2 kmol/h, corresponding to bicarbonate $2\times13.2$ kmol/h$=26.4$ kmol/h, the total amount of bicarbonate fed to the first 31 and the second 32 stages of hydrogen sulfide separation being 30.1 kmol/h and that of carbonate 8.3 kmol/h.

Part of the solution 33 (0.6 kmol $Na_2CO_3$/h, $NaHCO_3$ 0.2 kmol/h) from the second hydrogen sulfide separation stage 32 is used for scrubbing 34 the flue gases in order to remove the $SO_2$ (0.6 kmol/h) present in the flue gases. The leaving scrubbing solution 35 ($Na_2SO_3$ 0.6 kmol/h, $NaHCO_3$ 0.2 kmol/h) can be used separately for purposes using the said substances, or it can be returned to, for example, the circulation of chemicals in the pulp mill as a make-up chemical.

The amount of vapor, 5 t/h, required for the separation of hydrogen sulfide is generated, for example, by expanding the circulating solution of the flue gas scrubbing stage 34. Scrubbing stage circulating solution 38 enters the expansion at 46.8 $m^3/h$, at a temperature of 64° C. The circulating solution is expanded to the pressure of the hydrogen sulfide separation section, corresponding to a temperature of 58° C. The expansion releases vapor at 5 t/h, 58° C., for the separation of hydrogen sulfide, and 39 463 $m^3/h$ is returned at 58° C. to the scrubbing stage 34. The scrubbing stage circulating solution, when heating up, cools the flue gases from the due point temperature, 67.1° C., to 61.6° C.

The solution 17 (7.8 $m^3/h$) passing from the first hydrogen sulfide separation stage 31 to the causticization contains $Na_2CO_3$ 14.8 kmol/h, $NaHCO_3$ 2.7 kmol/h, NaHS 1 kmol/h, $Na_2SO_4$ 0.2 kmol/h, and NaCl 10.4 kmol/h, and it is treated with calcium hydroxide 7, the formed $CaCO_3$ precipitate 8 is separated, and the departing solution 9, which contains NaOH 30 kmol/h, $Na_2CO_3$ 2 kmol/h, $Na_2S$ 1 kmol/h, $Na_2SO_4$ 0.2 kmol/h, and NaCl 10.4 kmol/h, is directed to evaporation crystallization 40, in which water 41 is evaporated at 5.8 t/h, NaCl crystals 10 being separated at 9 kmol/h.

The mother liquor 11, which contains NaOH 30 kmol/h, $Na_2CO_3$ 2 kmol/h, $Na_2S$ 1 kmol/h, $Na_2SO_4$ 0.2 kmol/h and NaCl 1.4 kmol/h, can be used for various purposes. In this example it is directed to the $H_2S$ absorption 12.

It is also possible to take into the $H_2S$ absorption 12 the soda solution 30 separated by crystallization, whereby the sulfidity of the solution 29 leaving the $H_2S$ absorption 12 can be adjusted to a suitable level. If the flow 30 brings along with it $Na_2CO_3$ at 64.3 kmol/h and $Na_2SO_4$ at 3.7 kmol/h, the values for, for example, the flow 29 are: $Na_2S$ 13.5 kmol/h, NaHS 4.9 kmol/h, $NaCO_3$ 66.3 kmol/h, $Na_2SO_4$ 3.9 kmol/h, and NaCl 1.4 kmol/h. This solution 29 can be directed, as a flow having a low chloride concentration, for example back to the chemical cycle of the pulp mill, to its causticization plant.

EXAMPLE 2

Figure 2:
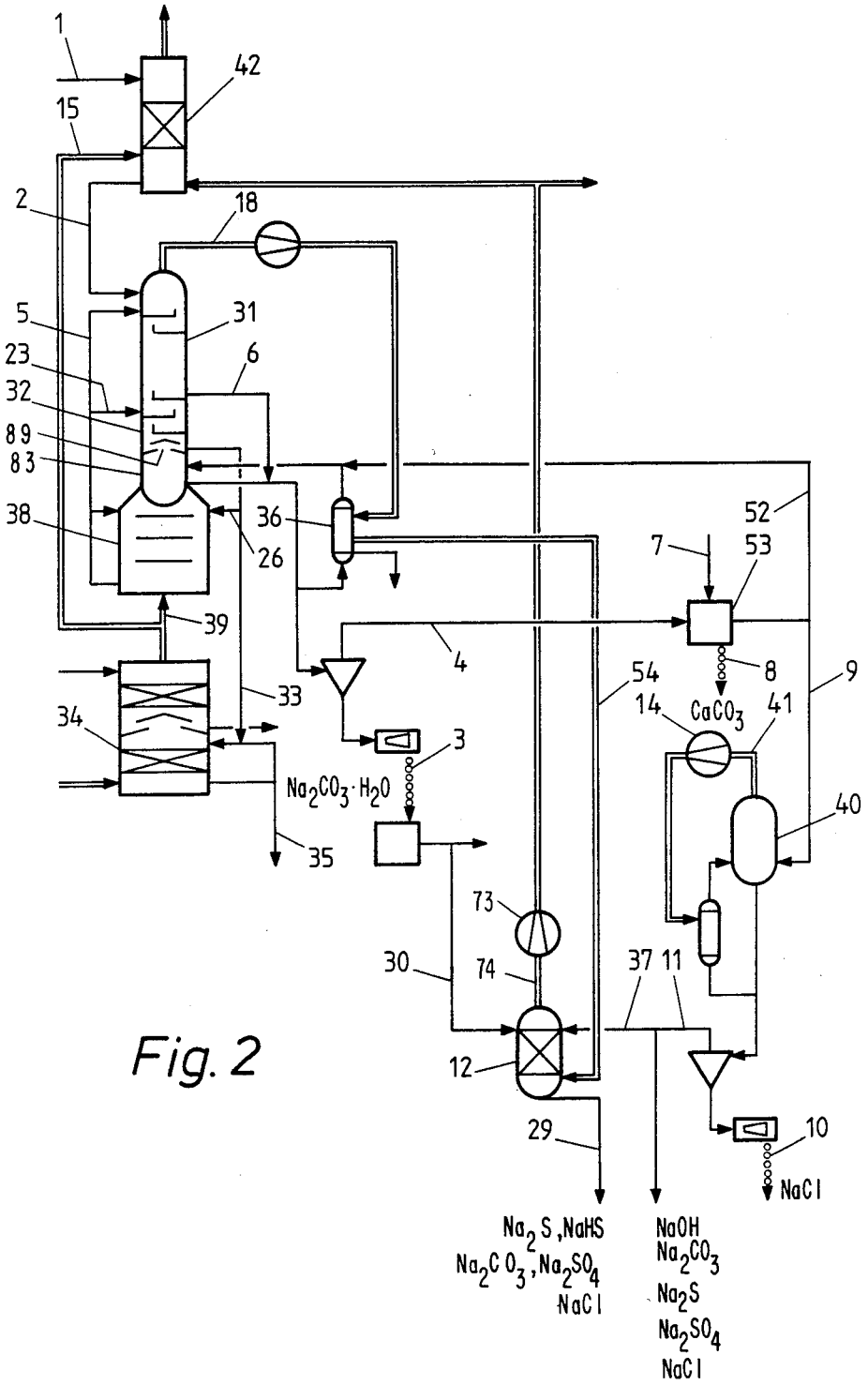

Green liquor 1, 40.4 $m^3/h$, which contains $Na_2CO_3$ 62.7 kmol/h, $Na_2S$ 19.6 kmol/h, $Na_2SO_4$ 3.9 kmol/h and NaCl 10.4 kmol/h, is directed into the process depicted in FIG. 2.

The solution is precarbonated in the reactor 42, and the reaction $$2Na_2S+H_2O+CO_2=2NaHS+Na_2CO_3$$

consumes carbon dioxide $0.5\times19.6$ kmol/h=9.8 kmol/h. Flue gases 15 are required for the precarbonation at 3290 $m^3n/h$, the inlet concentration of carbon dioxide being 12.97% and the degree of absorption of carbon dioxide being 51.7%.

The precarbonated solution 2 is directed to the first hydrogen sulfide separation stage 31.

The separation of hydrogen sulfide in accordance with the reaction $$NaHS+NaHCO_3\rightleftharpoons Na_2CO_3+H_2S$$

requires bicarbonate, which is introduced within the flow 5 into the first stripping stage 31 at 26.6 kmol/h and, along with it, carbonate at 7.4 kmol/h.

During the first hydrogen sulfide separation stage 31, hydrogen sulfide is separated at 18.1 kmol/h from the sulfide of the inlet solution 2. In the separation of hydrogen sulfide, bicarbonate is consumed not only in the principal hydrogen sulfide reaction but also in the secondary reaction $$2NaHCO_3\rightleftharpoons Na_2CO_3+CO_2+H_2O$$

corresponding to a bicarbonate amount of 1.9 kmol/h in the first stripping stage.

From the first hydrogen sulfide separation stage 31, solution passes to the second hydrogen sulfide separation stage 32 at 10.8 $m^3/h$, which contains $Na_2CO_3$ 20.7 kmol/h, $NaHCO_3$ 1.3 kmol/h, NaHS 0.3 kmol/h, $Na_2SO_4$ 1 kmol/h, and NaCl 2.8 kmol/h.

The rest of the sulfide-containing solution leaves the first hydrogen sulfide separation stage 21 as a flow 6 (40.6 $m^3/h$) which contains $Na_2CO_3$ 78.5 kmol/h, $NaHCO_3$ 5.2 kmol/h, NaHS 1 kmol/h, $Na_2SO_4$ 3.7 kmol/h, and NaCl 10.4 kmol/h, and passes to the evaporation crystallization 43 of soda.

Part of the bicarbonate is converted to carbonate by directing part of the causticized solution 52, amounting to 1.1 $m^3/h$ and containing $Na_2CO_3$ 0.3 kmol/h, NaOH 4.2 kmol/h, $Na_2S$ 0.1 kmol/h, NaCl 1.5 kmol/h and $Na_2SO_4$ 0.03 kmol/h, to the evaporation crystallization 83 of soda. In the evaporation crystallization 83, water 89 is evaporated at 35 t/h, $Na_2CO_3.H_2O$ crystals being separated at 63.6 kmol/h and $Na_2SO_4$ crystals at 3.7 kmol/h in the crystallizer 3. The mother liquor 4, 6.7 $m^3/h$, which contains $Na_2CO_3$ 19.5 kmol/h, NaHS 1.1 kmol/h, $NaHCO_3$ 0.9 kmol/h, $Na_2SO_4$ 0.2 kmol/h, and NaCl 11.9 kmol/h, is directed to the causticization 53.

To the second hdyrogen sulfide separation stage 32, bicarbonate 23 is added at 0.6 kmol/h and carbonate at 0.2 kmol/h. During the second hydrogen sulfide separation stage 31, bicarbonate is consumed at 1 kmol/h.

The hydrogen sulfide being separated during the second hydrogen sulfide separation stage 32 rises to the first stripping stage 31, from which it leaves along with the $H_2S$ gas being separated in the first stripping stage (total amount $H_2S$ 18.4 kmol/h), in line 18 from which water vapor is condensed 36, and the $H_2S$ gas 54 can be used for various purposes, e.g. burned into $SO_2$, directed to a Claus plant, or absorbed into a solution which contains sodium carbonate and/or sodium hydroxide and/or sodium sulfide. In this example, the $H_2S$ gas 54 is absorbed 12 into the NaOH solution 37 produced in the process, the solution containing NaOH 30 kmol/h, $Na_2CO_3$ 2 kmol/h, $Na_2S$ 1 kmol/h, $Na_2SO_4$ 0.2 kmol/h and NaCl 1.4 kmol/h. The outlet gases 74 from the $H_2S$ absorption are directed to the precarbonation 42 by means of a vacuum pump 73, by means of which the operating pressures of the hydrogen sulfide separation stages 31, 32 and the $H_2S$ absorption are adjusted.

The bicarbonate required for the separation of hydrogen sulfide is prepared using the carbon dioxide present in flue gases during the carbonization stage 38 in accordance with the reaction $$Na_2CO_3+CO_2+H_2O\rightleftharpoons 2NaHCO_3.$$

From the solution leaving the second hydrogen sulfide separation stage 32, a flow 26, which contains $Na_2CO_3$ 21.6 kmol/h and $NaHCO_3$ 1.3 kmol/h, is directed to carbonation 38, in which it is treated with flue gas 39 (26000 $m^3n/h$) having a $CO_2$ content of 12.97%. In carbonation 38 at an absorption efficiency of 8.75%, carbon dioxide is absorbed at 13.2 kmol/h, corresponding to bicarbonate $2\times13.2$ kmol/h=26.4 kmol/h, the amount of bicarbonate directed to the first 31 and second 32 separation stages being 27.6 kmol/h and that of carbonate 7.7 kmol/h.

Part of the solution 33 (0.65 kmol $Na_2CO_3$/h, $NaHCO_3$ 0.1 kmol/h) from the second hydrogen sulfide separation stage 32 is directed to the scrubbing 34 of the flue gases in order to remove the $SO_2$ (0.6 kmol/h) present in the flue gases. The outlet scrubbing solution 35 ($Na_2SO_3$ 0.6 kmol/h, $NaHCO_3$ 0.2 kmol/h) can be used separately for purposes using the substances in question, or it can be returned, for example, to the chemical cycle of the pulp mill as a make-up chemical.

The vapor used as the vapor required for the separation of hydrogen sulfide is vapor 89, 35 t/h, released from the crystallization 83.

The solution 4 passing into the causticization is treated with calcium hydroxide 7, the formed $CaCO_3$ precipitate 8 is separated. The outlet solution 9 contains NaOH 30 kmol/h, $Na_2CO_3$ 2 kmol/h, $Na_2S$ 1 kmol/h, $Na_2SO_4$ 0.2 kmol/h and NaCl 10.4 kmol/h, and it is directed to evaporation crystallization 40, in which water 41 (5.8 t/h) is evaporated, NaCl crystals 10 being separated at 9 kmol/h. The mother liquor 11, which contains NaOH 30 kmol/h, $Na_2CO_3$ 2 kmol/h, $Na_2S$ 1 kmol/h, $Na_2SO_4$ 0.2 kmol/h and NaCl 1.4 kmol/h, can be used for various purposes. In this example it is directed to the $H_2S$ absorption 12.

In addition, soda solution 30 separated by crystallization can be taken into the $H_2S$ absorption 12, whereby the sulfidity of the solution 29 leaving the $H_2S$ absorption can be adjusted to a suitable level. If $Na_2CO_3$ 64.3 kmol/h and $Na_2SO_4$ 3.7 kmol/h are introduced along with the flow 30, the values for, for example, the flow 29 will be $Na_2S$ 13.5 kmol/h, NaHS 4.9 kmol/h, $Na_2CO_3$ 66.3 kmol/h, $Na_2SO_4$ 3.9 kmol/h and NaCl 1.4 kmol/h, and this solution, as a flow having a low chloride concentration, can be returned, for example, to the chemical cycle of the pulp mill, to its causticization plant.

EXAMPLE 3

Figure 3:
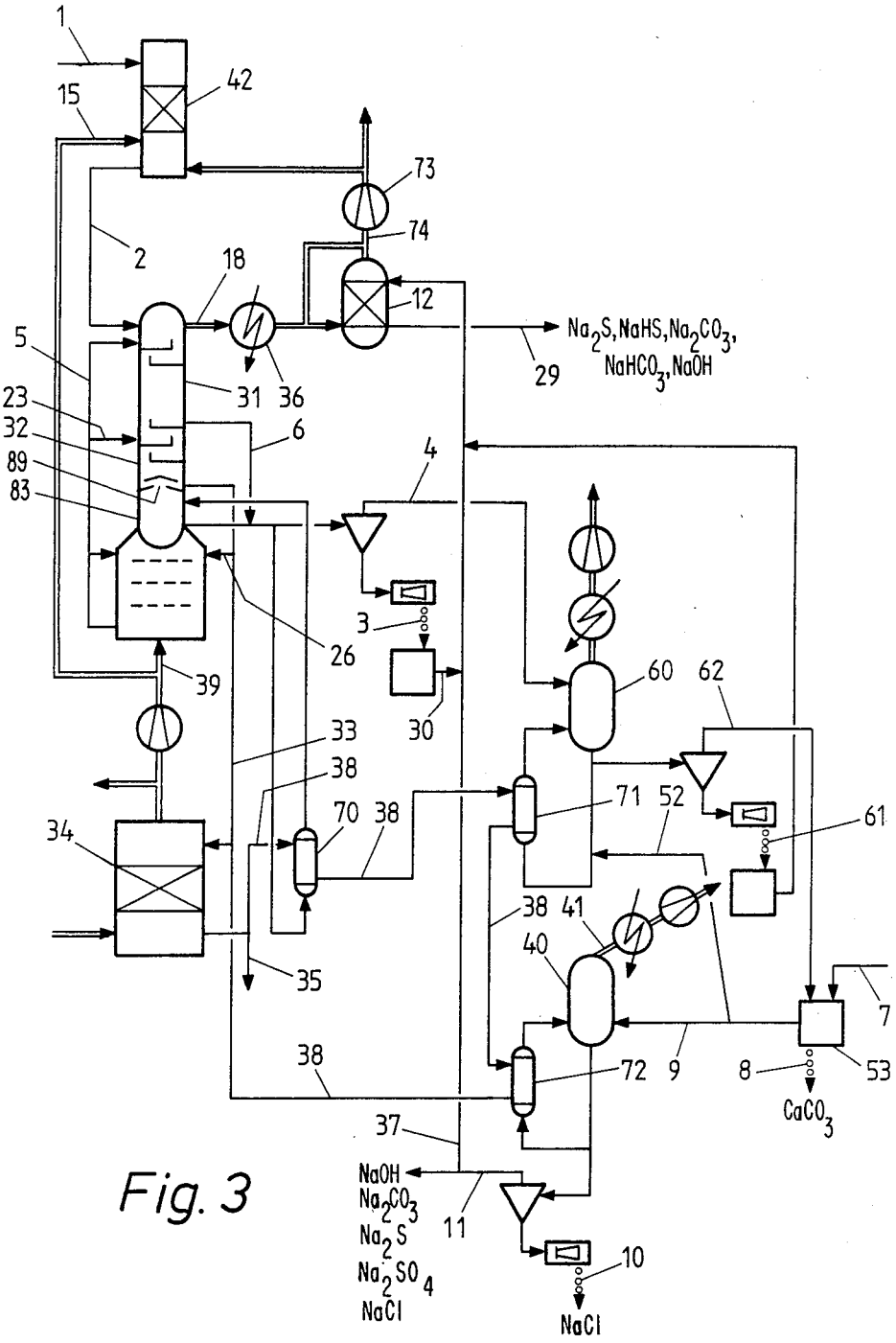

The process depicted in FIG. 3 is otherwise the same as that presented in FIG. 2, except that the outlet vapor 89 from the first crystallization stage 83 is directed to the hydrogen sulfide separation 32 and 31. The mother liquor 4 is directed to the second soda crystallization stage 60, and the soda 3 and 61 produced during the stages is used for suitable purposes. The mother liquor is directed to the causticization 53.

The heat required by the crystallization stage 83 is first transferred by means of a heat exchanger 70 from the circulating solution 38 of the flue gas scrubber. From the crystallization stage 43 the cooled circulating solution 38 is transferred to the heat exchanger 71, in which it yields the heat required by the crystallization stage 60. Further, the heat required by the chloride crystallization 40 is extracted from the circulating solution 38 by means of the heat exchanger 72, whereafter the cooled circulating solution 38 is returned to the flue gas scrubber, in which it cools the flue gases, thereby itself becoming heated. The pressures of the crystallization stages are adjusted so that the operating pressure is highest in stage 83 and lowest in stage 40. All the stages operate under low pressure.

What is claimed is:

1. A method for recovering chemicals from a chloride-containing green liquor comprising:

contacting the chloride-containing green liquor with flue gases in order to precarbonate sulfide present in the green liquor, such that the resulting solution contains chloride, hydrosulfide and sodium carbonate;

evaporation crystallizing the chloride-, hydrosulfide-, and sodium carbonate-containing solution in order to separate crystalline sodium carbonate, thereby leaving an alkaline chloride- and hydrosulfide-containing solution;

reacting the alkaline chloride- and hydrosulfide-containing solution with bicarbonate to form an alkaline sodium carbonate-, chloride-, and hydrogen sulfide-containing solution;

removing said hydrogen sulfide from the solution;

causticizing and evaporation crystallizing the resulting alkaline sodium carbonate-, and chloride-containing solution in order to separate the chloride salt from the alkaline solution;

absorbing the hydrogen sulfide, derived from the removal of hydrogen sulfide, into a sodium carbonate solution derived from said crystalline sodium carbonate, said alkaline solution, or a mixture thereof in order to produce a solution suitable for the preparation of white liquor; and directing the hydrogen sulfide, which remains unabsorbed, to the precarbonation stage.

2. A method according to claim 1, wherein gases generated in the evaporation crystallization of sodium carbonate are compressed, and used for raising the temperature of the solution to be evaporation crystallized to produce sodium carbonate.

3. A method according to claim 1, wherein uncondensed gases derived from the evaporation crystallization of sodium carbonate are combined with hydrogen sulfide gases from the hydrogen sulfide removal stage.

4. A method according to claim 1, wherein the steps of reacting the alkaline chloride- and hydrosulfide-containing solution with bicarbonate, and removing said hydrogen sulfide from the solution are accomplished by:

reacting, in a first stage, the alkaline chloride- and hydrosulfide-containing solution with a bicarbonate solution to form an alkaline sodium carbonate-, chloride-containing solution, and hydrogen sulfide within said alkaline sodium carbonate-, chloride-containing solution;

removing the hydrogen sulfide thus formed from the first stage;

passing at least a portion of the alkaline sodium carbonate-, chloride-containing solution from the first stage to a second stage;

reacting the alkaline sodium carbonate-, chloride-containing solution with a bicarbonate solution, in the second stage, to form hydrogen sulfide within said alkaline sodium carbonate-, chloride-containing solution;

removing the hydrogen sulfide thus formed from the second stage; and removing at least a portion of the alkaline sodium carbonate-, chloride-containing solution, from the second stage, and using a portion to obtain the bicarbonate solution which is fed to both the first and second stages.

5. A method according to claim 4, wherein at least a portion of the alkaline sodium carbonate-, chloride-containing solution derived from said first stage is evaporation crystallized together with the chloride-, hydrosulfide-, and sodium carbonate-containing solution in order to separate crystalline sodium carbonate.

6. A method for recovering chemicals from a chloride-containing green liquor comprising:

contacting the chloride-containing green liquor with flue gases in order to precarbonate sulfide present in the green liquor, such that the resulting solution contains chloride, hydrosulfide and sodium carbonate;

reacting the chloride-, hydrosulfide-, and sodium carbonate-containing solution with bicarbonate to form a chloride-, sodium carbonate-, and hydrogen sulfide-containing solution;

removing said hydrogen sulfide from the solution;

evaporation crystallizing the resulting chloride- and sodium carbonate-containing solution in order to separate crystalline sodium carbonate thereby leaving an alkaline chloride-containing solution;

causticizing and evaporation crystallizing the alkaline chloride-containing solution in order to separate chloride salt from the alkaline solution;

absorbing the hydrogen sulfide, derived from the removal of hydrogen sulfide, into a sodium carbonate solution derived from said crystalline sodium carbonate, said alkaline solution, or a mixture thereof in order to produce a solution suitable for the preparation of white liquor; and directing the hydrogen sulfide, which remains unabsorbed, to the precarbonation stage.

7. A method according to claim 6, wherein gases generated in the step of evaporation crystallizing the chloride- and sodium carbonate-containing solution are used for removing said hydrogen sulfide from the solution.

8. A method according to claim 6, wherein gases from the separation of hydrogen sulfide are used for raising the temperature of the solution to be evaporation crystallized to produce sodium carbonate.

9. A method according to claim 6, wherein the circulating solution, which is used for scrubbing the flue gases to be used for the precarbonation, is used for raising the temperature of the solution to be evaporation crystallized to produce sodium carbonate.

10. A method according to claim 6, wherein hydrogen sulfide gases obtained from the hydrogen sulfide separation stage are compressed and used for raising the temperature of the chloride- and sodium carbonate-containing solution to be evaporation crystallized.

11. A method according to claim 6, wherein said chloride- and sodium carbonate-containing solution is evaporation crystallized in two stages.

12. A method according to claim 6, wherein the steps of reacting the chloride-, hydrosulfide-, and sodium carbonate-containing solution with bicarbonate, and removing said hydrogen sulfide from the solution are accomplished by:

reacting, in a first stage, the chloride, hydrosulfide-, and sodium carbonate-containing solution with a bicarbonate solution to form a chloride-, sodium carbonate-containing solution and hydrogen sulfide within said chloride-, sodium carbonate-containing solution;

removing the hydrogen sulfide thus formed from the first stage;

passing at least a portion of the chloride-, sodium carbonate-containing solution from the first stage to a second stage;

reacting the chloride-, sodium carbonate-containing solution with a bicarbonate solution, in the second stage, to form hydrogen sulfide within said chloride-, sodium carbonate-containing solution;

removing the hydrogen sulfide thus formed from the second stage; and removing at least a portion of the chloride-, sodium carbonate-containing solution, from the second stage, and using a portion to obtain the bicarbonate solution which is fed to both the first and second stage.

13. A method according to claim 12, wherein gases generated in the step of evaporation crystallizing the chloride- and sodium carbonate-containing solution are used for removing said hydrogen sulfide from the solution.

14. A method according to claim 12, wherein gases from the separation of hydrogen sulfide are used for raising the temperature of the solution to be evaporation crystallized to produce sodium carbonate.

15. A method according to claim 12, wherein the circulating solution, which is used for scrubbing the flue gases to be used for the precarbonation, is used for raising the temperature of the solution to be evaporation crystallized to produce sodium carbonate.

16. A method according to claim 12, wherein hydrogen sulfide gases obtained from the hydrogen sulfide separation stage are compressed and used for raising the temperature of the chloride- and sodium carbonate-containing solution to be evaporation crystallized.

17. A method according to claim 12, wherein said chloride- and sodium carbonate-containing solution is evaporation crystallized in two stages.

* * * * *